US005463524A

United States Patent [19]

Szirmai

[11] Patent Number: 5,463,524

[45] Date of Patent: Oct. 31, 1995

[54] PRODUCING ELECTROSUSPENSIONS

[75] Inventor: Stephen G. Szirmai, Northbridge, Australia

[73] Assignees: Commonwealth Scientific and Industrial Research Organisation, Campbell; Auspharm International Limited, Perth, both of Australia

[21] Appl. No.: 834,521

[22] PCT Filed: Aug. 9, 1990

[86] PCT No.: PCT/AU90/00339

§ 371 Date: Mar. 10, 1992

§ 102(e) Date: Mar. 10, 1992

[87] PCT Pub. No.: WO91/23914

PCT Pub. Date: Feb. 21, 1991

[30] Foreign Application Priority Data

Aug. 10, 1989 [AU] Australia ..... PJ-5702

[51] Int. Cl.[6] ..... H01H 19/00

[52] U.S. Cl. ..... 361/230

[58] Field of Search ..... 361/225–227, 361/229, 230, 231; 250/324, 326; 118/723 R, 629, 621; 55/127, 124; 96/60–63, 95–97; 422/121

[56] References Cited

U.S. PATENT DOCUMENTS

| | | | |
|---|---|---|---|
| 3,233,156 | 2/1966 | Jarvis et al. | 361/229 |
| 3,670,699 | 6/1972 | Sargent | 118/629 |
| 3,806,763 | 4/1974 | Masuda | 361/227 |
| 3,958,162 | 5/1976 | Kuehnle | 361/229 |
| 4,161,765 | 7/1979 | Itoh et al. | 361/226 |
| 4,240,125 | 12/1980 | Kuehnle . | |
| 4,389,225 | 6/1983 | Willett et al. . | |
| 4,440,552 | 4/1984 | Uchiya et al. . | |
| 4,440,800 | 4/1984 | Morton et al. | 427/459 |
| 4,467,332 | 8/1984 | Akutsu | 346/140 R |
| 4,701,941 | 10/1987 | Szirmai et al. | 378/122 |
| 4,737,885 | 4/1988 | Akutsu | 361/225 |

FOREIGN PATENT DOCUMENTS

| | | | |
|---|---|---|---|
| 116406 | 1/1943 | Australia . | |
| 60-92834 | 5/1985 | Japan | 361/226 |
| 1161181 | 6/1985 | U.S.S.R. . | |
| 2075353 | 11/1981 | United Kingdom . | |
| 2074610 | 11/1981 | United Kingdom . | |

OTHER PUBLICATIONS

Derwent Publications Ltd., Translated Abstract of Japan 60–140669, Jul. 1985.

J. Appl. Phys. 55 (11), 1 Jun. 1984 "Vapor Coating of Electrostatically Dispersed Powders" (1984 American Inst. Physics).

J. Appl. Phys. 51(10), Oct. 1980 "The Dispersion of Powders by Intense Electrostatic Field" (1980 American Inst. of Phys.).

Derwent Publications Ltd., London, Database WPIL, Accession No. 85–322427, GB & SU–A–1161 181 (Leonov S.B.), Jun. 1985.

*Primary Examiner*—A. D. Pellinen
*Assistant Examiner*—Fritz M. Fleming
*Attorney, Agent, or Firm*—Leydig, Voit & Mayer

[57] ABSTRACT

An apparatus is provided for production of an electrosuspension of particles including spaced electrodes receiving an electrical potential and disposed within an insulating container, at least one of the electrodes rotatable by a motor. The rotatable electrode preferably includes a plurality of spaced electrodes circumferentially disposed in a drum configuration. Field concentrating conductors may be coupled to the rotatable electrode to generate ions and irradiate the surface of the particulate material with ions.

23 Claims, 2 Drawing Sheets

PRODUCING ELECTROSUSPENSIONS

TECHNICAL FIELD

This invention relates to improvements in apparatus used to produce electrosuspension of particulate matter such as powders.

BACKGROUND ART

Electrosuspension, also known as electrodispersion, is a technique for suspending fine particulate matter within closed or open containers and is usually produced by applying high DC-potential to appropriately configured stationary electrodes fixed within a dispersing chamber. The suspension effect is produced by the interaction between the applied electric field and the particles. The suspensions are typically in the form of a dust-cloud which partially fills the container above a static powder bed. Concentration of the cloud may be adjusted by raising or lowering, as required, the voltage that is applied to the electrodes. A typical but not exclusive electrode configuration is one where an electrode is embedded within the static powder bed, while the other is positioned some 20–30 mm above the surface of the powder. Although there are a number of possible polarity combinations which can be used, it is often the case that the embedded electrode is at earth potential. While the applied voltage necessary to cause suspensions is determined by factors such as the relative spacing of the electrodes, the weight, size and shape of particles, it is mostly well above 10 kV and can be as high as 30–40 kV. Particle sizes are typically in the range of from a few microns to several hundred microns.

Developments in the art of electrosuspensions have been reported in the J. of Appl. Phys., 1980, 51 (10 5215–5222 and 5223–5227, and in the J. of Appl. Phys., 1984 55 (11) 4088–4094. Examples of applications of these developments are also given in the United Kingdom patents 2074610B and 2143989.

Prior art electrosuspension apparatus have sufferred several inherent disadvantages:

Firstly, particles easily polarized by the electric field, such as contained by many crystalline dielectrics (e.g.: KCl, NaCl, sugar, ascorbic acid, nicotinamid), tend to align themselves with the field and with each other, forming chains, filaments or needles in the process. There is a tendency for these formations to attach themselves to one of the electrodes and act as field-concentrators, giving rise to intermittent and later continuous ionization of air within the dispersing space. As ionized air is electrically conducting, this mechanism can collapse the high voltage field, resulting in the sharp reduction of the suspended cloud. The formation of filaments can be especially prevalent in case of fibrous dust, such as asbestos and cellulose, and it is often the case that these type of powders form solid bridges extending between the electrodes, while voltage is applied.

Additionally, in applications which involve the treatment or us of the suspended dust, (such as the vapour coating of particles), it is often necessary to remove the suspension from within the electrode space. While removal can sometimes be effected by a cross-airstream through the system, this is not always viable. Removal techniques based on the tendency of particles to 'shoot past' the upper electrode, being propelled by their own upward momentum have not generally succeeded, as the fixed upper electrode acts as a physical barrier to the particles. This difficulty has ben addressed by adapting electrode design, for example, by using a wiremesh type configuration. However, the tendency of the particles to eventually block up openings can not be easily eliminated and is particularly prevalent with dielectric dust. A factor further limiting the amount and concentration of dust which can emerge through the electrode region is the reverse charging of particles by physical contact with the electrode, effectively reversing the charge and therefore the direction of force which the particles experience.

Yet another difficulty exists in relation to the electrosuspension of particles having a size of a few microns. Particles of this size are often referred to as micronised particles and as used herein this term refers to particles having a size of less then 30 μm. Hitherto, it has not been possible to effectively generate an electrosuspension of many types of micronised powders.

This has placed severe limitations on the practical use of the electrosuspension process in areas such as the pharmaceutical powders industry, in paint-pigments manufacture and handling, in areas of medical technology and the like where often ultrafine powders must be used with particle sizes in the range of 2–5 μm or less.

DISCLOSURE OF THE INVENTION

It is an object of this invention to provide an apparatus for producing an electrosuspension of particles which will overcome or at least ameliorate one or more of the above disadvantages.

Accordingly, in one aspect this invention consists in an apparatus for producing an electrosuspension of particles comprising a container to receive a bed of said particles, at least two electrodes disposed within said container for the generation of an electric field to establish said electrosuspension above the bed, at least one of said electrodes being mounted for high speed rotation by associated drive means.

In a second aspect this invention consists in an apparatus for producing an electrosuspension of micronised particles comprising a container to receive said particles, at last two electrodes disposed within said container for the generation of an electric field to establish said electrosuspension, a first of said electrodes, in use, being disposed in contact with a bed of said particles and a second of said electrodes being spaced apart from said bed of particulate material, and electric field concentrating means connected with said second electrode to generate ions and irradiate the surface of said bed of particles with ions of opposite polarity to said first electrode.

In a third aspect this invention provides a method for producing a electrosuspension of micronised particles comprising the steps of applying an electric field transversely across a bed of said particles and a region adjacent one surface thereof and irradiating said one surface with ions of a polarity naturally propelled toward said one surface by the electric field such that secondary ionisation of air or gases within the particle bed occurs sufficient to allow electrosuspension of the particles.

In embodiments of the invention, the container may include an opening disposed opposed to a first major surface of one of the electrodes and remote from the bed of particles for extracting the electro-suspension of particles. Further, an axis of rotation of said second electrode may be substantially parallel to a major surface of the bed of particles.

Preferably, in the second aspect of the invention the second electrode is also mounted for high speed rotation by associated drive means. The concentrating means preferably comprise thin wires attached to the second electrode.

It is further preferred that the electrode mounted for high speed rotation or "rotatable electrode" has an open configuration to allow the particles to pass through or across the electrode. In this respect, the electrode can, for example, be of "mesh-like" construction or have a drum like configuration as shown in the accompanying drawings. Alternatively, the electrode can be similar to a fan comprising blades across which the particles may pass.

Preferably the rotatable electrode(s) is/are capable of angular speeds in excess of 1500 rpm while being electrically charged to normal dispersing potential, usually in the range 10 kV to 40 kV.

The rotatable electrode(s) can be charged to either negative or positive polarity, or be operated at earth potential. Pulsed charging and superimposed AC on DC charging and/or operating the electrodes in a purely AC mode are also possible.

Preferably at least one rotatable electrode is positioned above the surface of a static bed of particles to be suspended, with sufficient clearance to prevent direct electrical contact with the bed. In one embodiment the rotational axis is substantially parallel to the bed surface but it will be appreciated that many other configurations are possible.

Where more than one rotatable electrode is utilised, these can be operated at different rotational speeds and directions or in any suitable combination thereof.

The rotating electrode can be constructed from any suitable known material or combination of materials for example, dielectric materials in combination with metals. In some applications the materials are selected to ensure a smooth operation in a dusty environment.

The electrosuspension apparatus according to the invention has been found to provide the following advantages:

i) The provision of a charged region of space, through which particles are substantially free to move;

ii) A substantial reduction in the tendency of powders to form filaments during dispersion;

iii) A substantial reduction in ionization discharge resulting from the attachment of particles to the electrodes;

iv) The production of aerodynamic forces to propel particles through the rotor;

v) The reduction of inter-electrode spacing;

In the case of micronised particles the apparatus of the second aspect of this invention has been found to allow the effective electrosuspension of particles not capable of electrosuspension in prior art devices. The inability of prior art devices to successfully create electrosuspensions of many micronised particles is thought to be a consequence of the high electrical resistivity such particles exhibit in bulk.

Where the apparatus consists of a stationary electrode embedded in the bed of particulate material, the usual mode of charging the particles is by electronic conduction. The high electrical resistivity due to contact resistances between the particles of micronised powders prevents or hinders the charging of particles by electron-conduction through the bed in apparatus used to generate suspensions. Under normal dispersing (electrosuspension) conditions, the application of voltage to the electrodes results in the charging of surface particles by conduction of electrons from the embedded electrode to the surface of the bed, via the individual particle-contacts throughout the bed. It is known that beds of particles consisting of small dielectric particles exhibit a volume resistance increasingly determined by the number of contacts, rather than the overall electrical resistance of the particles themselves, especially as particles get smaller. It is also known that contact resistance between dielectric surfaces is non-ohmic, i.e. current is not in proportion to the applied voltage. This is further illustrated by the non-ohmic resistance of bulk powder, so that electrical resistance depends on the applied voltage, rather than being an independent constant determined only by the electrical properties of the material. With decreasing sizes the number of inter-particle contacts are known to multiply, which can lead to volume resistivities well in excess of $10^{12}$ ohm-cm for ultra-fine powder, thereby preventing the continuous and regular passage of charge needed to maintain a suspension.

It should be noted that there are some micronised powders which do not exhibit the above properties. For example a sample of free-running nickel powder, consisting of 3–5 μm spherical particles, was found to disperse quite freely, while other more cohesive metal powders show some reduced activity. Exceptions also exist among ultrafine non-metal powders, such as micronised pyridoxin hydrochloride, which does show some dispersion after appropriate surface-treatment of the powder, though particles tend to disperse as 30 μm agglomerates rather than individuals. Theoretically, the ability to disperse a few ultrafine powders is probably due to a presently little understood mechanism which regulates the contact resistance between particles.

The essence of the second aspect of this invention is to circumvent the conduction charging of particles (made difficult by the high electrical resistance of a powder bed) by providing an alternative or additional mechanism that relies upon the secondary phenomenon of back-ionization.

Back-ionization is an electrostatic effect rarely encountered in high voltage practice other than electrostatic precipitation, where it represents an unwanted side effect which reduces the efficiency of the precipitation process and is one to be eliminated as much as possible.

Thus, according to the second aspect of this invention, the particles may be charged by the secondary ionization of air or gases within the particle bed, which secondary ionization occurs in response to spraying the bed with primary ions preferably produced by a corona-discharge within the electrosuspension container.

BRIEF DESCRIPTION OF THE DRAWINGS

The invention will now be described, by way of example only, with reference to the accompanying drawings in which.

MODES FOR CARRYING OUT THE INVENTION

Figure 1:
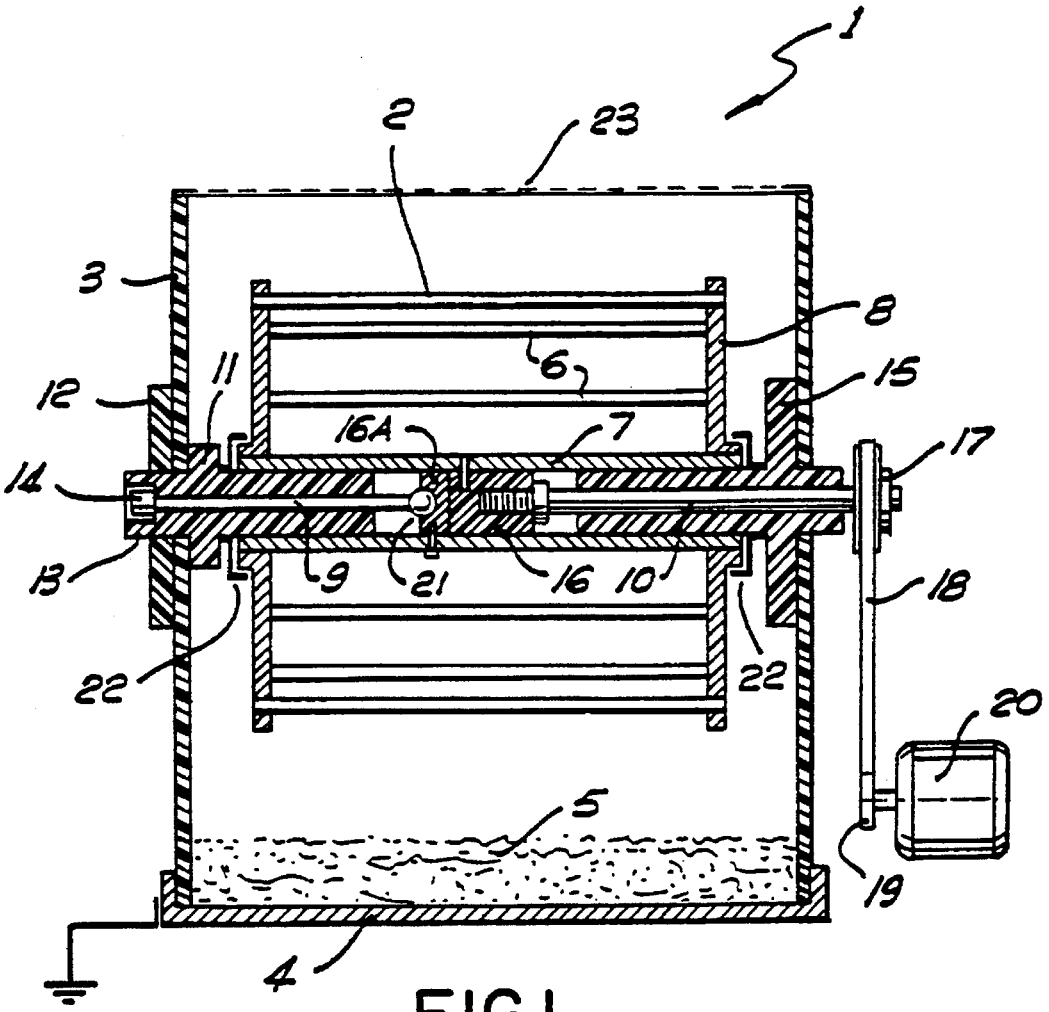
FIG. 1 is a schematic illustration of the apparatus according to the first aspect of the invention.

Referring to FIG. 1 there is shown an apparatus 1 for the electrosuspension of the particles which includes an electrode 2 mounted for rotation within an insulating container 3. A second electrode 4 is fitted within the bottom of container 3 below a bed of particulate material 5. The rotatable electrode 2 comprises a drum like rotor formed by circumferentially spaced conductors 6 extending substantially parallel to and equally distant from a hollow cylindrical tube 7. The conductors 6 are joined to respective disk shaped end portions 8 secured to the tube 7. The rotatable electrode 2 is mounted by shafts 9 and 10 above the particle or powder bed 5. Shaft 9 is disposed within a teflon bearing 11 about which the rotor rotates. The assembly comprising the shaft 9 and bearing 11 is fixed to a wall of container 3 by an insulating retaining ring 12. The outer end of the shaft 9 is surrounded by further insulation 13 to form an electrical contact 14. Shaft 10 is rotatably mounted within a further teflon bearing 15 which is fixed to the side of container 3. One end of shaft 10 is fixed by means of an insulating bush 16 to the cylindrical centre tube 7 of electrode 2. The other end of shaft 10 protrudes from container 3 and is fitted with a pulley 17. A belt 18 extends between pulley 17 and a like pulley 19 on an electric motor 20. In this way, the electric motor can be energised to rotate electrode 2. Electrical connection between shaft 9 and the electrode 2 is maintained by means of a steel ball 21 disposed in a recess within a conducting portion 16A of bush 16. The ball 21 effectively provides a bearing between the stationary end of shaft 9 and the bush portion 16A whilst the insulating remainder of bush 16 prevents electrical contact with shaft 10.

Dust sleeves 22 are fitted between the teflon bearings 11, 15 and the respective ends 8 of electrode 2 to exclude dust from the bearing surfaces.

In use, an electrical potentional is applied between electrodes 2 and 4 and electrode 2 is rotated by means of a current supplied to electric motor 20. This creates an electric field in the region between the two electrodes and results in the generation of an electrosuspension of the particles. Because the electrode 2 has an open configuration and due to the turbulence caused by the rotation the electrosuspension rises into the area above the electrode 2. From this area the suspension can be readily removed by any suitable known means. In the embodiment shown in FIG. 1 container 3 has an open top fitted with a grid 23 to provide for the filtering out of any coarse particles in the electrosuspension.

Figure 2:
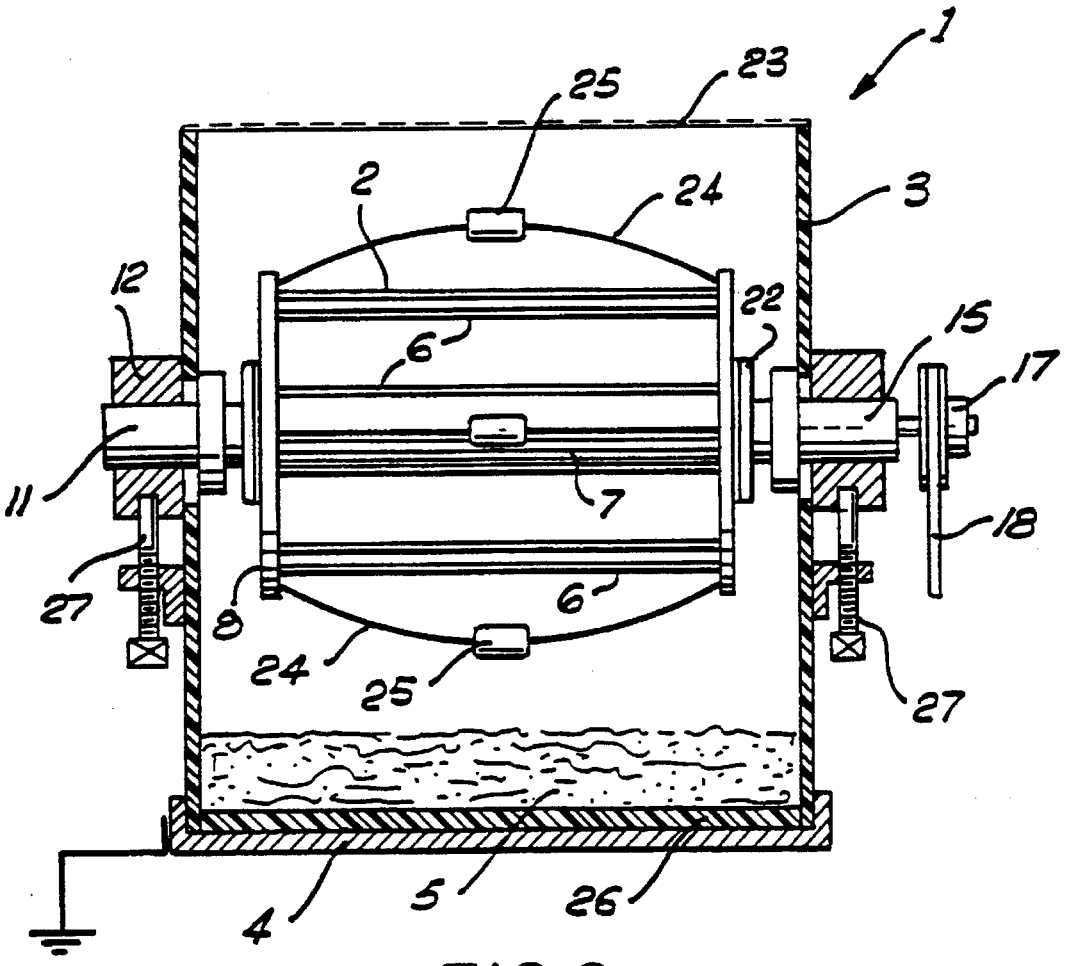
FIG. 2 is a schematic illustration of apparatus similar to FIG. 1 which includes the second aspect of this invention.

Referring to FIG. 2 the arrangement illustrated is generally the same as that described in relation to FIG. 1 above. For ease of understanding the same reference numerals have been used to identify corresponding parts. In the FIG. 2 arrangement a number of thin wires 24 are symmetrically positioned about the periphery of electrode 2. Each wire 24 extends arcuately between the ends 8 of the electrode and is weighted at its centre by means of a porcelain bead 25. Additionally, the FIG. 2 arrangement includes a solid semi-conducting layer 26 covering electrode 4.

The apparatus of FIG. 2 is particularly designed for use with micronised particles which do not under normal circumstances readily form an electrodispersion. The operation of the device is generally similar as that described above in that a potential is applied between the electrodes and electrode 2 is rotated at a relatively high speed by motor 20. The thin wires 24 attached to electrode 2 extend outwardly under the action of centrifugal force and act as field concentrators to produce a corona-discharge. This results in an ionization of the air or other gas within the container 2. Such corona-ionization is an effect well known to those familiar with electrostatics and has wide application in areas such as Electrostatic Precipitation, where it is usually produced by a static pair of electrodes using a point/plane or thin wire/plane construction. With the present invention, the ions are generated by the rapidly rotating positive electrode 2. The resulting negative ions are immediately re-absorbed by the electrode, whilst positive ions are sprayed onto the surface of the particles 5, as a result of electrostatic attraction and by the aerodynamic forces to which the electrode 2 gives rise. Due to the high electrical resistance of the bed 5, these ions do not immediately dissipate but form a positive charge-layer on the surface of the bed 5, the underside of which is at the opposite potential, caused by electrical contact with the lower electrode 4,26. In turn, this gives rise to a high potential drop across the particle bed 5 causing the ionization of air within the interstitial space between particles. This is usually termed back-ionization and is a known secondary effect by which ions of both signs are produced, one being rapidly absorbed by the electrode, while the other is driven upward through the particles and is absorbed by the particles which thus become charged. Using the above proposed polarity configuration, these are negative ions, i.e., electrons, resulting in the immediately dispersion of the particles, which forms a cloud of suspended particles above the bed 5.

An optional feature of the invention is the provision of means for adjusting the electrical potential across the particle bed. This may be achieved by adjustable vertical positioning of the upper electrode, which allows bed-thickness to be varied as required as schematically illustrated in FIG. 2 at 27. This can also be achieved using an appropriate semi-conductor substrate for the bed, as illustrated in 26 in FIG. 2 is provided, through which electrical contact can be made with the lower electrode. A miss-match of resistances between the interelectrode space and the layer of particles can result in either of the following two unwanted conditions: (1) insufficient potential difference across the bed to give rise to secondary ionization and (2) the potential difference across the bed is too high relative to the interelectrode voltage, so that when the potential across the bed is suddenly added to the former as charges begin to flow, then the combined potential exceeds the sparking voltage for the system, causing electrical sparks and discharges in place of the continuous secondary ionization which is required.

By way of illustration of the invention the following experiment has been performed. In an apparatus as described with reference to FIG. 1 an electrosuspension was generated using 100 gm of dry KCl (containing 0.05% free flow agent additive) by applying 25,000 volts to the rotationable electrode positioned 30 mm above the powder bed. The rotor was 45 mm diameter and 60 mm long. The density of the electrosuspension was monitored by using a transmitted He—Ne laser beam and by measuring the attenuation of the beam through the cloud with a Laser Power Meter. Operation of the rotor at 1400 r.p.m. caused a drop of over 40% in the transmitted beam intensity from the initial 2.8 mw measured with the rotor stationary. This indicates a considerable increase in the density of the suspension.

INDUSTRIAL APPLICABILITY

One example for using the above invention is in producing coated pharmaceutical powders for controlling the release rate of the active ingredient through a semi-permeable membrane covering each particle. The electrosuspension of particles is well suited for the continuous production of such surface-treated powders, as the particles are separate from each other and in continuous agitation while in dispersion, thus allowing the coating to be applied by a suitable technique, e.g: by spraying them with fast-drying aerosol. The main difficulty, however, is to produce satisfactory electrosuspensions, since many pharmaceutical substances contain easily polarized crystals which tend to form filaments under the action of the electric field. Often, these substances are also quite hygroscopic which further exacerbates the problem, resulting in extremely poor an uneven dispersions that usually decrease with time, until the process stops. By using the apparatus of the present invention, this problem has been sharply reduced and a dense cloud of suspended substance can be maintained, sufficient for most electrosuspension coating applications.

Another example for applying the present invention is in the area of dry paper-making. Paper is usually formed by the process of floating individual paper fibres (originating from treated wood-pulp) in large vats of water and allowing the fibres to settle on a suitable substrate, e.g: a moving wire-mesh strip, from where the paper is removed and dried. In view of the large quantities of water which must be handled (typically ½ ton of water for 2 kgs of paper), a technique which would allow the dry separation and floating of fibres is likely to have important economic significance. The electrostatic suspension of cellulose dust is one such possible technique, but due to the earlier mentioned tendency of fibrous dust to form long chains and filaments when subjected t a high voltage field, cannot be used in practice. By using the apparatus of the present invention, a suspension of fibrous dust can be maintained as a result of the mechanical disruption of the filament-forming process by the rotatable electrode, thereby eliminating the problem with adapting this technique to dry paper-making.

A further example for the use of the present invention is in coating of solids. For instance, the invention makes it possible to produce electrostatically coated abrasive, such as belts, disks and paper to which fine silicon carbide, emery, etc., is glued using grit-sizes much finer than presently possible. It also becomes possible to 'weld' ceramics to metal by depositing ultra-fine ceramic dust on a heated metal surface, which minimises the cooling of the surface by large heat capacity grains, so that direct sintering of the grains may be achieved both to the metal surface and to each other. The bonding of ceramics to metal is an important technological problem occurring in modern automotive engineering as well as in aviation and the space industry and has not yet been solved in an economically viable manner.

Another example for the use of the invention is for producing aerosols of ultrafine medically active substances, such as salbutamol sulphate, pentamadin and steroids, suitable for the treatment of various forms of asthma, aids, etc., by directly inhaling them into the lungs. Present inhalers of dry ultrafine powders in the 1–3 μm size range typically based on compressed CFC delivery of the dust, for which breathing must be co-ordinated with the bursts of powder generated by the device. In most cases, this is a difficult requirement, especially for children. Devices which rely on a suction generated when the patient inhales deeply are also known. However, deep inhalation can be difficult or impossible for an asthmatic and these devices are therefore of limited use. It has been found, the present invention has the capacity for overcoming the problem, as demonstrated for salbutamol sulphate which was dispersed from an apparatus, as shown in FIG. 2, producing a slowly rising cloud of ultrafine powder which may be inhaled by breathing normally.

A further example for the use of this invention is in making new surface-active catalysts, by coating the micronised catalyst onto the individual grains of an 'inert' carrier, such as a 30 μm alumina powder, to which the micronised particles can stick due to natural adhesion forces. The technique could be used to replace present less economical methods for manufacturing such surface-active catalysts, where the active material is spread over the carrier grains by precipitating them from a liquid.

I claim:

1. An apparatus for use in a device producing an electro-suspension of particles, the apparatus comprising:

a container to receive a bed of said particles;

at least first and second electrodes coupled to said container for the generation of an electric field to establish said electro-suspension above the bed, at least said second electrode being rotatably mounted; and drive means for rotating the second electrode at a high speed.

2. An apparatus as claimed in claim 1 wherein said second electrode has an open configuration allowing for the passage of said electro-suspension of particles.

3. An apparatus as claimed in claim 2 wherein said second electrode has a drum like configuration including a plurality of circumferentially spaced conductors extending substantially parallel to and equidistant from an axis of rotation.

4. An apparatus as claimed in claim 1 wherein said second electrode has a rotation rate greater than 1500 r.p.m.

5. An apparatus as claimed in claim 1 wherein the first electrode is disposed in contact with said bed of said particles and said second electrode is disposed adjacent said bed of said particles.

6. An apparatus as claimed in claim 5 wherein said container includes an opening disposed opposed to a first major surface of said second electrode and remote from said bed of said particles for extracting said electro-suspension of particles.

7. An apparatus as claimed in claim 5 wherein an axis of rotation of said second electrode is substantially parallel to a major surface of said bed of particles.

8. An apparatus as claimed in claim 1 further comprising means for adjusting an electrical resistance between said electrodes.

9. An apparatus as claimed in claim 8 wherein said electrical resistance is adjusted by varying the spacing between said first and second electrodes.

10. An apparatus as claimed in claim 8 including a layer of semi-conductor material interposed between one of the first and second electrodes and said particles, wherein said electrical resistance is adjusted by said layer of semi-conductor material.

11. An apparatus as claimed in claim 1 wherein said electro-suspension of said particles is due to ionization of gasses between the particles in said bed.

12. An apparatus for use in a device producing an electro-suspension of micronized particles, the apparatus comprising:

a container to receive said micronized particles, at least first and second electrodes coupled to said container for the generation of an electric field to establish said electro-suspension, said first electrode being disposed in contact with a bed of said particles and having a first polarity, said second electrode being spaced apart from said bed of particles; and electric field concentrating means connected to said second electrode to generate ions and irradiate the surface of said bed of particles with ions of opposite polarity to said first electrode.

13. An apparatus as claimed in claim 12 wherein said concentrating means comprise thin wires connected to said second electrode.

14. An apparatus as claimed in claim 12 wherein said second electrode is rotatably mounted and including drive means for rotating said second electrode at a high speed.

15. An apparatus as claimed in claim 14 wherein said container includes an opening disposed opposed to a first major surface of said second electrode and remote from said bed of said particles for extracting said electro-suspension of particles.

16. An apparatus as claimed in claim 14 wherein an axis of rotation of said second electrode is substantially parallel to a major surface of said bed of particles.

17. An apparatus as claimed in claim 14 wherein said second electrode has an open configuration allowing for the passage of said electro-suspension of particles.

18. An apparatus as claimed in claim 14 wherein said second electrode has a rotation rate greater than 1500 r.p.m.

19. An apparatus as claimed in claim 12 further comprising means for adjusting an electrical resistance between said electrodes.

20. An apparatus as claimed in claim 12 wherein said electro-suspension of said particles is due to ionization of gasses between particles in said bed.

21. A method for use in producing an electro-suspension of micronized particles, the method comprising the steps of:

applying an electric field transversely across a bed of said particles and a region adjacent one surface thereof by rotating an electrode near the bed; and irradiating said one surface with ions of a polarity naturally propelled toward said one surface by the electrical field such that secondary ionization of air or gases within the bed of said particles occurs sufficient to allow electro-suspension of said particles.

22. A method as claimed in claim 21 wherein applying an electric field includes disposing electrodes on opposite sides of the bed and applying a potential to said electrodes, whereby said electric field is generated by electrodes respectively disposed on transversely opposite sides of said bed.

23. A method as claimed in claim 22 wherein irradiating said one surface with said ions includes concentrating the electric field near said one surface of the bed of said particles.

* * * * *